United States Patent [19]

Mercer et al.

[11] 4,241,912

[45] Dec. 30, 1980

[54] ISOMETRIC VAGINAL EXERCISE DEVICE AND METHOD

[76] Inventors: Lloyd F. Mercer; Jean H. R. Mercer, both of 2509 N. Campbell Ave., Suite 196, Tucson, Ariz. 85719

[21] Appl. No.: 7,045

[22] Filed: Jan. 29, 1979

[51] Int. Cl.[3] ..... A63B 21/00

[52] U.S. Cl. ..... 272/125; 128/79; 128/341

[58] Field of Search ..... 128/341, 727, 260, 151, 128/152, 79, 341, 778, 25; 272/125

[56] References Cited

U.S. PATENT DOCUMENTS

| | | | |
|---|---|---|---|
| 672,377 | 4/1901 | Kearns | 128/341 UX |
| 1,278,944 | 9/1918 | Landis | 128/260 |
| 1,610,947 | 12/1926 | Hosmer | 128/341 |
| 1,928,893 | 10/1933 | Hoard | 128/341 |
| 2,763,265 | 9/1966 | Waters | 128/343 |
| 3,598,106 | 8/1978 | Bunning | 128/778 |
| 3,675,642 | 7/1972 | Lord | 128/341 |
| 3,752,150 | 8/1973 | Harris | 128/778 |
| 3,821,956 | 7/1974 | Gordhamer | 128/343 |
| 3,926,178 | 12/1975 | Feldzamen | 128/778 |
| 4,048,985 | 9/1977 | Sasse | 128/778 |
| 4,050,449 | 9/1977 | Castellana | 128/778 |
| 4,167,138 | 9/1979 | Remich | 128/778 |

*Primary Examiner*—Lawrence W. Trapp
*Attorney, Agent, or Firm*—Cahill, Sutton & Thomas

[57] ABSTRACT

An isometric vaginal exercise device includes a rounded shaft having a flange attached to one end thereof. The shaft has a concave portion adjacent the flange, wherein the diameter of the concave portion decreases to a minimum value and then increases to a maximum value with increasing distance from the flange along the shaft, whereby the concave portion allows more effective gripping of the isometric vaginal exercise device by perivaginal muscles of the user. The flange is substantially oval to permit convenient accommodation between the legs of the user. A handle is attached to the flange end of the isometric vaginal exercise device. A method of using the isometric device to improve muscle tone of the muscles of the pelvic diaphragm is disclosed.

9 Claims, 7 Drawing Figures

ISOMETRIC VAGINAL EXERCISE DEVICE AND METHOD

BACKGROUND OF THE INVENTION

1. Field of the Invention

The invention relates to vaginal exercise devices and methods of using vaginal exercise devices to improve muscle tone of perivaginal muscles.

2. Description of the Prior Art

The perivaginal anatomy consists of two major sets of muscles, including a set of sphincter muscles and a set of supporting muscles. The supporting muscles have the appearance of a hammock having its ends attached to the sides of the pelvic bones. The sphincter muscles and the supporting muscles in combination are commonly referred to as the pelvic diaphragm. Three hollow tube-like structures, the urethra, the vagina, and the rectum, extend downwardly through respective openings in the central portion of the pelvic diaphragm. Where the muscle tone of the pelvic diaphragm is good, these openings are maintained in a constricted condition by virtue of the tightness of the muscles of the pelvic diaphragm. However, the muscle tone of the pelvic diaphragm commonly deteriorates as a result of poor physical conditioning, injuries associated with child birth, and atrophy associated with aging. As a result, the openings in the pelvic diaphragm become progressively larger and lax. This laxity is associated with a number of female problems, including fallen bladder, fallen rectum, uterine prolapse, stress incontinence of urine (leaking urine caused by coughing or other muscle straining), difficulties with voiding, cystitus, decreases sexual responsiveness, and chronic discomfort. In the absence of a rigorous program of conditioning and exercising the muscles of the pelvic diaphragm, these conditions generally can be corrected only by major surgery and incurring of the usual risks associated with major surgery. It has been found that regular exercise of the muscles of the pelvic diaphragm improves the general muscle tone, resulting in improved voluntary muscle control, increased strength and reinervation of previously injured muscles, and can generally prevent, correct, or at least improve the above female conditions associated with pelvic relaxation. It also has been found that the physical condition of the perivaginal muscles is directly related to sexual responsiveness and sexual pleasure of the female during intercourse. It is also known that improved muscle tone achieved by voluntary exercise of the muscles of the pelvic diaphragm is desirable as a preparation for childbirth because well-toned muscles stretch during childbirth and contract to their original lengths more readily than poorly toned muscles.

Various intravaginal devices have been disclosed for enabling a woman and/or her physician to observe the amount of pressure voluntarily applied to the muscles of the pelvic diaphragm in order to help the woman attain voluntary control of such muscles and to carry out a program of exercising the muscles of the pelvic diaphragm. U.S. Pat. No. 2,507,858 discloses a perinometer having a hollow tube which is inserted into the vagina. Air trapped in the hollow tube communicates with a pressure gauge by means of a hose, indicating the amount of pressure being exerted by the vaginal muscles. This device is quite expensive, inconvenient and unpleasant to use. Further, it does not provide suitable resistance to contraction of vaginal muscles to be suitable in a rigorous program of muscle rebuilding. Its main use is as a diagnostic tool and as a tool for enabling a woman to initially learn voluntary muscle control of her vaginal muscles by providing visual feedback which aids the learning of such voluntary muscle control. Various other devices, including those disclosed in U.S. Pat. Nos. 3,598,106, 3,752,150, 3,926,178, 4,048,985, and 4,050,449, all disclose intravaginal devices having hollow tubes which compress air or other fluids, producing an indication on a sensor (such as a gauge) to provide feedback to the woman indicating the amount of vaginal control she has attained. However, the known devices suffer from the shortcomings that they are expensive, inconvenient, bulky, and in some cases, somewhat embarrassing or unpleasant to use. Further, most of the intravaginal devices disclosed in the above patents suffer the additional shortcoming that they do not suitably remain in proper position in the vagina when strong contractions of the muscles of the pelvic diaphragm are made.

Although programs of exercising the muscles of the pelvic diaphragm are known to be beneficial, voluntary programs of such routine exercise are seldom sustained long enough to be satisfactory. This is due in part to the above short-comings of the known devices. As with any device designed to be inserted vaginally, psychological objections by some patients must be overcome. The size and complexity of the known devices may tend to increase these objections, despite reassurance by the physician. Further, the complexity of the prior intravaginal devices makes cleaning a difficult and inconvenient task, further increasing patient resistance to continued use of such devices for a sufficiently long period of time to adequately improve vaginal muscle tone of the user.

There is clearly an unmet need for a simple, small low cost vaginal exercise device which can be easily and privately utilized, cleaned, and transported by the average female patient.

Accordingly, it is an object of the invention to provide a low cost vaginal exercise device and to provide a method for utilizing and attaining proficiency in utilizing the vaginal exercise device to improve vaginal muscle tone without undue effort, inconvenience, or embarrassment to the user.

It is another object of the invention to provide a vaginal exercise device which overcomes common psychological objections to use of such devices.

Yet another object of the invention is to provide a vaginal exercise device which is easily cleaned.

Still another object of the invention is to provide a low cost vaginal exercise device which is conveniently and easily accommodated between the legs of the user.

A further object of the invention is to provide a vaginal exercise device which resists muscular contractions of the pelvic diaphragm more efficiently than intravaginal devices of the prior art.

A yet further object of the invention is to provide an isometric vaginal exercise device.

SUMMARY OF THE INVENTION

Briefly described, and in accordance with one embodiment thereof, the invention provides an isometric vaginal exercise device having a shaft which has a substantially round cross-sectional area. The vaginal exercise device has first and second ends, the first end having a flange attached thereto and a second end which is rounded to permit easy insertion of the isometric vaginal exercise device. The shaft has a substantially concave contour adjacent the flange, wherein the diameter of the shaft decreases to a minimum value and then increases to a maximum value with increasing distance from the flange along the shaft. The concave contour permits improved gripping of the isometric vaginal exercise device by perivaginal muscles of the user, and also prevents it from slipping out of the vagina as the perivaginal muscles are tightened. The flange has a substantially oval configuration to permit easy accommodation of the vaginal exercise device between the legs of the user. A handle is attached to the flange end of the isometric vaginal device to permit its easy insertion and removal. In a presently preferred embodiment of the invention, the isometric vaginal exercise device is made of solid latex rubber of sufficient hardness that maximum strength contractions of vaginal muscles by the user are resisted without substantial deformation of the device. The isometric vaginal exercise device can be utilized in accordance with a vaginal muscle exercise program to repair deteriorated muscles of the pelvic diaphragm, thereby completely or partially correcting problems such as urinary incontinence, cervical prolapse, and various other female problems associated with pelvic floor relaxation without surgery and its accompanying complications. The user first learns or attains perivaginal muscle control by utilizing her finger and exercising vaginal muscles as if to stop urine flow. Once voluntary muscle control has been attained, the isometric vaginal exercise device is utilized by inserting it into the vagina. The user then successively tightens and relaxes the perivaginal muscles until the exercise can be continually accomplished for twenty minute periods twice a day. After this level of control has been achieved, the muscle tone improvement program is continued by making maximum strength contractions of the perivaginal muscles, holding such contractions for ten seconds, and then relaxing the perivaginal muscles for ten second periods for fifty to one hundred repetitions twice a day.

DESCRIPTION OF THE INVENTION

Figure 1:
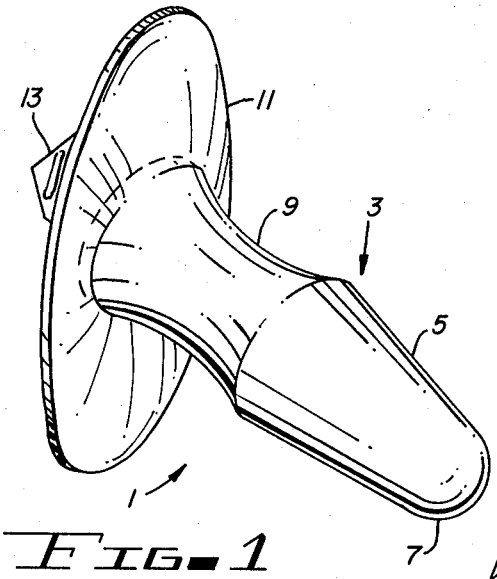
FIG. 1 is a perspective view of the isometric vaginal exercise device of the present invention.

Referring now to the drawings, particularly to FIGS. 1–5, isometric vaginal exercise device 1 includes a shaft 3 having a tapered end portion 5 and a concave portion 9. End 7 of shaft 3 is rounded to ease insertion of the vaginal exercise device into a vagina. At the opposite end of shaft 3 an oval flange 11 is attached. A handle 13 having a plurality of ribs 19 disposed on either side thereof is attached to the outer or back side 12 of flange 11.

Figure 2:
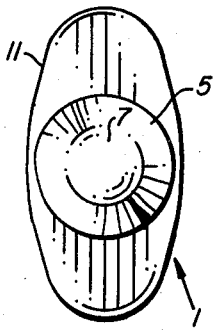
FIG. 2 is an end view of the shaft end of the isometric vaginal exercise device of FIG. 1.
Figure 3:
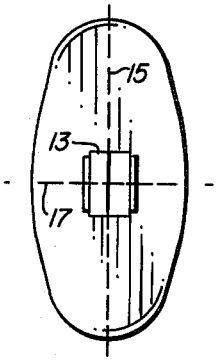
FIG. 3 is an end view of the handle end of the vaginal exercise device of FIG. 1.
Figure 4:
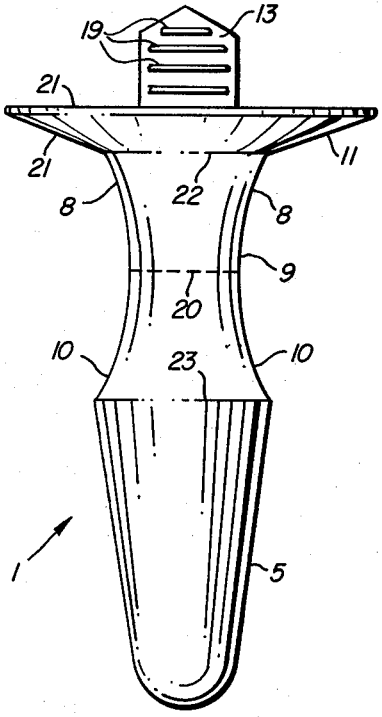
FIG. 4 is a side view of the vaginal exercise device of FIG. 1.

A front or shaft side view of isometric vaginal exercise device 1 is shown in FIG. 2; an end view of the handle end of the device is shown in FIG. 3. Referring to FIG. 3, it can be seen that oval flange 11 includes a major axis 15 and a relatively shorter minor axis 17. From the side view of vaginal exercise device 1 shown in FIG. 4, it can be seen that the curvature of concave portion 9 extends from boundary 23 (a point of maximum shaft diameter) and gradually decreases to a point of minimum diameter, indicated by dotted line 20, and again gradually increases until boundary 22 (another point of maximum shaft diameter) is reached. The inner tapered surface 21 of flange 11 extends from boundary 22 outwardly to the periphery of oval flange 11.

In the presently described embodiment of the invention, the entire isometric vaginal exercise device 1 is constructed as an integral unit of solid latex rubber. The length of shaft 3, measured from the tip of rounded end 7 to boundary 22 is approximately three and one-half inches, the distance between boundaries 22 and 23 is approximately one and five-eighths inches, and the diameters at boundaries 22 and 23 are approximately one and one-fourth inches. The minimum diameter of concave portion 9 at dotted line 20 is approximately seven-eighths of an inch. The length of major axis 15 (FIG. 3) of flange 11 is approximately two and one-half inches, and the length of minor axis 17 is approximately one and one-half inches.

The purpose of concave portion 9 is to enable the perivaginal muscles of the user to effectively grip shaft 3 above concave portion 9, so that sloped surfaces 8 and 10 are securely gripped by the perivaginal muscles during use of the device, thereby preventing it from slipping out of the vagina as the perivaginal muscles are tightly contracted by the user.

Handle 13, of course, enables the user to easily insert and remove the vaginal exercise device from her vagina; ribs 19 facilitate gripping of handle 13 between the user's thumb and fingers.

The oval configuration of flange 11 permits flange 11 to be comfortably accommodated between the legs of the user while the vaginal exercise device is inserted, yet permits flange 11 to effectively limit the depth to which vaginal exercise device 1 is inserted into the vagina of the user.

Although solid latex rubber is utilized for construction of the illustrated device as an integral unit, other materials could be utilized. It is important, however, that the material be sufficently hard to effectively resist even the strongest vaginal contractions which may be applied to it in order to provide the greatest benefit. Latex rubber serves ideally because although it has a rather soft surface which is easily cleaned, is sufficiently soft to be comfortable to use, is non-toxic, and does not cause scratching of vaginal tissue.

Figure 6:
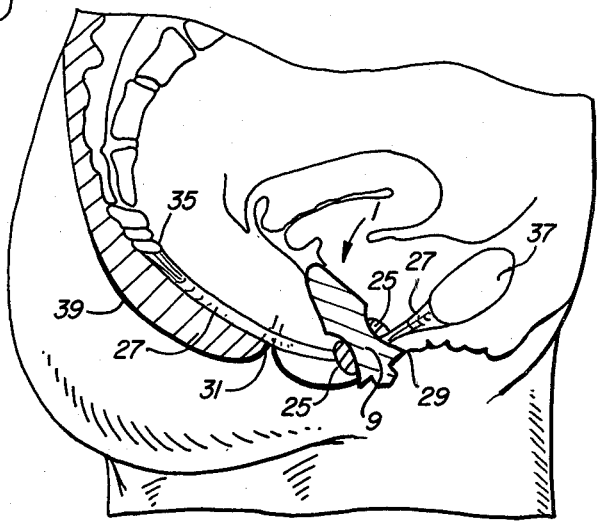
FIG. 6 is a sectional view illustrating insertion of the vaginal exercise device of FIG. 1 into a woman's vagina with the perivaginal muscles relaxed.
Figure 5:
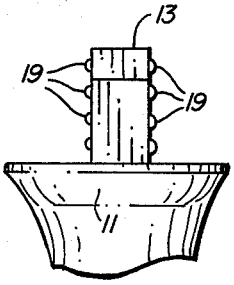
FIG. 5 is a partial top view of the vaginal exercise device of FIG. 1.
Figure 7:
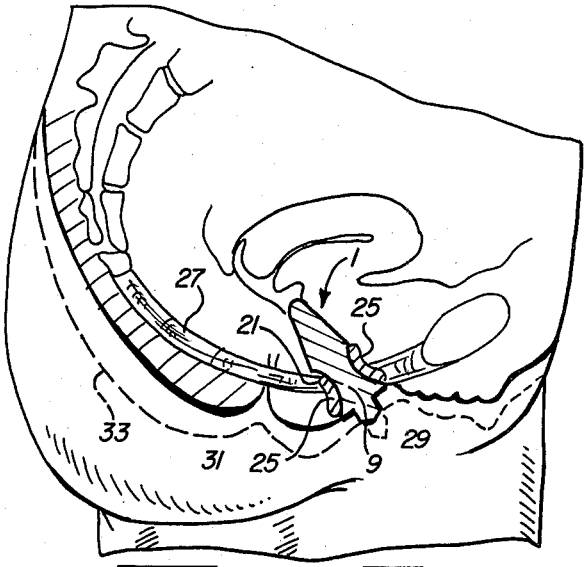
FIG. 7 is a partial sectional view illustrating the vaginal exercise device of FIG. 1 inserted into a woman's vagina with the perivaginal muscles tightened about the concave portion of the shaft.

The use of isometric vaginal exercise device 1 is best understood with reference to FIGS. 6 and 7, which illustrate the perivaginal or sphincter muscles 25, the vaginal opening 29, the rectum 31, and the pelvic diaphragm muscles 27 which are stretched between the bones 35 and 37, which are the pubic rami and the coccyx, respectively.

FIG. 6 illustrates the configuration of the pelvic muscles in their relaxed condition with vaginal exercise device 1 properly inserted into vaginal opening 29 so that the perivaginal muscles 25 surround concave portion 9 of shaft 3.

FIG. 7 illustrates the configuration of the pelvic diaphragm 27 when the vaginal muscles are tightened. It can be seen that the perivaginal muscles 25 tend to expand laterally, tightly gripping sloped surfaces 8 and 10 of concave portion 9, thereby effectively preventing vaginal exercise device 1 from being forced out of the vaginal canal by the tightening of the muscles of the pelvic diaphragm and encouraging lifting of the pelvic diaphragm. The lifting of the pelvic diaphragm is a desirable result made possible by gripping of sloped surface 10 by the perivaginal muscles and leads to improved muscle tone and coordination of the pelvic muscles. The tightening of the muscles of the pelvic diaphragm has a tendency to cause a lifting of the pelvic diaphragm, raising pelvic diaphragm 27 and vaginal exercise device 1. Dotted lines 33 represent the relaxed configuration shown in FIG. 6, and indicates the extent of lifting of the pelvic floor and vaginal exercise device 1 caused by contracting of the vaginal muscles.

Before one uses isometric vaginal exercise device 1 in conjunction with an exercise program for improving the muscle tone of vaginal muscles, one must first develop an awareness of the ability to voluntarily contract the perivaginal muscles. A recommended technique for learning to voluntarily contract such muscles is for a woman to insert a finger a short distance into her vagina while lying in a comfortable position and relaxing all of her muscles. The user should attempt to squeeze her finger with her vagina muscles by tightening the muscles used in shutting off or stopping urine flow. This should be practiced until a slight squeezing pressure can be maintained on the finger when the abdomen, thigh, and buttocks muscles are all relaxed. Most women can learn to voluntarily control their perivaginal muscles within a few days using the above described technique.

At this point, the woman can begin development of muscle tone of the perivaginal muscles. The first step is to lie in a comfortable position and gently insert the isometric vaginal exercise device 1 into her vagina, using either natural lubrication or a water soluble lubricant, such as surgical lubricant. After completely relaxing the abdomen, buttocks, and thigh muscles, the woman should contract her perivaginal muscles, causing them to squeeze the isometric vaginal exercise device. The contractions need not be strong, but need to be maintained for at time period long enough to take two or three deep breaths, and should be followed by a relaxing of the vaginal muscles for an equal duration of time. The above exercises should be practiced twice a day until the woman can continue each exercise session for approximately twenty minutes. The amount of time that it takes to attain this level of muscle tone depends on the initial condition of the woman's pelvic diaphragm, but most women would be able to reach this level after one to two months of diligent practice.

At this point, the woman is ready to begin to take full advantage of the isometric exercising capability of the vaginal exercise device. The exercises should be performed with the woman concentrating on her perivaginal muscles, and squeezing as hard as possible on the isometric vaginal exercise device and maintaining the contraction for ten seconds without holding her breath, tensing her abdomen, buttocks, or thigh muscles. She then relaxes the perivaginal muscles for ten seconds and again tightens them for another ten second period. After several months of such exercising, the woman should be able to perform from fifty to one hundred maximum strength contractions in each of two daily sessions. At this point, she should have achieved strong, firm and healthy perivaginal muscles. From this time on, three to four sessions of maximum strength contraction exercises per week is sufficient to maintain muscle tone.

Once healthy perivaginal muscle tone has been attained, the vaginal exercise device of the present invention may be utilized when the woman is standing, due to the unique design of the device. More strain is placed upon the perivaginal muscles when the woman is in the standing position. Further, more muscle control is required. However, these two factors increase the benefits of the exercises.

While the invention has been described with reference to a particular embodiment thereof, those skilled in the art will recognize that variations may be made to the disclosed apparatus and method without departing from the true spirit and scope of the invention.

We claim:

1. An isometric vaginal exercise device comprising:

a. a shaft having first and second ends, said shaft being substantially round;

b. flange means connected to the first end of said shaft for limiting insertion of said isometric vaginal exercise device into the vagina of a user, wherein said flange means is substantially oval, said flange means having a major axis and a minor axis, said isometric vaginal exercise device being insertable into a vagina so that the major axis is approximately parallel to the vaginal slit, the length of the minor axis being such that the flange fits conveniently between the legs of the user;

c. handle means attached to the first end of said shaft for enabling a user to conveniently insert and remove said isometric vaginal exercise device into and from her vagina, said shaft being rounded at its second end to ease insertion of said isometric vaginal exercise device, said shaft having a longitudinal axis and a substantially concave portion adjacent said flange, a portion of said shaft immediately adjacent to said flange having a first diameter, the diameter of said shaft gradually decreasing to a second diameter at a first point on said axis, said first point being located approximately centrally of said concave portion, the diameter of said shaft gradually increasing to a third diameter at a second point on said axis, said second point being located at an end of said concave portion, a first portion of said isometric vaginal device being located between first and second planes perpendicular to said axis and passing through said first and second points, respectively, the distance between said first and second points and said second and third diameters being selected to allow sufficient gripping of said first portion to effect substantial lifting of the pelvic diaphragm of the user when she tightens her vaginal muscles on said isometric vaginal exercise device, enabling the user to achieve isometric exercising of the vaginal muscles and muscles of the pelvic diaphragm while the muscles of the pelvic diaphragm are in a shortened configuration resulting from said lifting, said isometric vaginal exercise device being of sufficiently solid construction to substantially resist all muscular contractions of the user without substantial deforming of said isometric vaginal device.

2. The isometric vaginal exercise device of claim 1, wherein said isometric vaginal exercise device is composed of latex rubber.

3. The isometric vaginal exercise device of claim 2 wherein said shaft, said flange, and said handle means are constructed as a unit.

4. The isometric vaginal exercise device of claim 1 wherein the diameter along said minor axis is approximately one and one-half inches and the diameter along said major axis is approximately two and one-half inches.

5. A method of utilizing a vaginal exercise device to exercise vaginal muscles, said method comprising the steps of:

a. inserting a vaginal exercise device of substantially solid construction into the vagina of a woman, the vaginal exercise device including a shaft of rounded configuration and a flange attached to one end of the shaft, the shaft having a longitudinal axis and a substantially concave portion adjacent said flange, a portion of said shaft immediately adjacent to said flange having a first diameter, the diameter of said shaft gradually decreasing to a second diameter at a first point on said axis, said first point being located approximately centrally of said concave portion, the diameter of said shaft gradually increasing to a third diameter at a second point on said axis, said second point being located at an end of said concave portion, a first portion of said isometric vaginal device being located between first and second planes perpendicular to said axis and passing through said first and second points, respectively, the distance between said first and second points and said second and third diameters being selected to allow sufficient gripping of said first portion to effect substantial lifting of the pelvic diaphragm of the user when she tightens her vaginal muscles on said isometric vaginal exercise device, enabling the user to achieve isometric exercising of the vaginal muscles and muscles of the pelvic diaphragm while the muscles of the pelvic diaphragm are in a shortened configuration resulting from said lifting, said isometric vaginal exercise device being of sufficiently solid construction to substantially resist all muscular contractions of the user without substantial deforming of said isometric vaginal device;

b. tightening the perivaginal muscles for a first predetermined length of time such that the perivaginal muscles grip the concave portion of the shaft, said tightening tending to pull the vaginal exercise device further into the vagina, said tightening being performed with sufficient intensity to effect substantial lifting of the woman's pelvic diaphragm;

c. relaxing the perivaginal muscles for a second predetermined period of time;

d. repeating steps (b) and (c) for a third predetermined number of times; and (e) removing the vaginal exercise device from the vagina.

6. The method of claim 5 further including learning voluntary control of the perivaginal muscles by attempting to tighten the perivaginal muscles upon a finger inserted into the opening of the vagina, said tightening being performed as if to voluntarily stop flow of a urine stream, said attempting being repeated until voluntary control of the perivaginal muscles is learned prior to performing step (a).

7. The method of claim 5 wherein said first predetermined period of time is approximately ten seconds and said second interval of time is approximately ten seconds, steps (b) and (c) being repeated from fifty to one hundred times during a single exercise session.

8. The method of claim 5 performed without substantial contracting of any accessory muscles, such as stomach, thigh, or buttocks muscles.

9. An isometric vaginal exercise device comprising:

a. a shaft having first and second ends, said shaft being substantially round;

b. flange means connected to the first end of said shaft for limiting insertion of said isometric vaginal exercise device into the vagina of a user; and c. handle means attached to the first end of said shaft for enabling a user to conveniently insert and remove said isometric vaginal exercise device into and from her vagina, said shaft being rounded at its second end to ease insertion of said isometric vaginal exercise device, said shaft having a longitudinal axis and a substantially concave portion adjacent said flange, a portion of said shaft immediately adjacent to said flange having a first diameter, the diameter of said shaft gradually decreasing to a second diameter at a first point on said axis, said first point being located approximately centrally of said concave portion, the diameter of said shaft gradually increasing to a third diameter at a second point on said axis, said second point being located at an end of said concave portion, a first portion of said isometric vaginal device being located between first and second planes perpendicular to said axis and passing through said first and second points, respectively, the distance between said first and second points and said second and third diameters being selected to allow sufficient gripping of said first portion to effect substantial lifting of the pelvic diaphragm of the user when she tightens her vaginal muscles on said isometric vaginal exercise device, enabling the user to achieve isometric exercising of the vaginal muscles and muscles of the pelvic diaphragm while the muscles of the pelvic diaphragm are in a shortened configuration resulting from said lifting, said isometric vaginal exercise device being of sufficiently solid construction to substantially resist all muscular contractions of the user without substantial deforming of said isometric vaginal device, wherein the length of said shaft is approximately three and one-half inches, said first diameter is approximately one and one-fourth inches, said second diameter is approximately seven-eighths of an inch, said third diameter is approximately one and one-fourth inches, and the distance between said first and third diameters is approximately one and five-eighths inches.

* * * * *